US005238401A

United States Patent [19]

Frericks et al.

[11] Patent Number: 5,238,401

[45] Date of Patent: Aug. 24, 1993

[54] SLAGGING ROTARY KILN

[75] Inventors: Raymond J. Frericks, Hector, Minn.; Johnny H. Price, Jr., Copan, Okla.

[73] Assignee: Westinghouse Electric Corp., Pittsburgh, Pa.

[21] Appl. No.: 679,461

[22] Filed: Apr. 2, 1991 (Under 37 CFR 1.47)

[51] Int. Cl.[5] ..... F27B 7/00

[52] U.S. Cl. ..... 432/103; 432/105; 432/118

[58] Field of Search ..... 432/103, 105, 118, 119

[56] References Cited

U.S. PATENT DOCUMENTS 3,751,220 8/1973 Rossi ..... 432/105
4,026,821 5/1977 Schoofs et al. ..... 432/118
4,300,837 11/1981 Malbrunot ..... 432/118
4,427,376 1/1984 Etnyre et al. ..... 432/105
4,859,177 8/1989 Kreisberg et al. ..... 432/105

*Primary Examiner*—Henry C. Yuen
*Attorney, Agent, or Firm*—G. H. Telfer

[57] ABSTRACT

An improved kiln wherein a smile shaped oil cooled refractory support is shortened so its distal end is adjacent the outside end of a front nose ring on a rotatable kiln drum, the nose ring being extended radially inwardly to shield the distal end of the smile shaped support from radiant energy from the kiln drum and direct combustion air over the distal end of the smile shaped support to prevent thermally induced stress cracking and substantially reduce the amount of partially burned material that spills over the front nose ring.

7 Claims, 3 Drawing Sheets

SLAGGING ROTARY KILN

BACKGROUND OF THE INVENTION

The invention relates to a rotary kiln and more particularly to an improvement in the front wall refractory support and the rotary kiln adjacent thereto.

The kiln front wall refractory support member, referred to as the smile, has a history of failures which necessitated costly kiln downtime and repairs. In addition the end of the kiln adjacent the feed chute, called the nose ring, allowed partially incinerated waste material to spill over into the air inlet damper requiring frequent removal and reburning of the spilled material.

The front wall refractory support, referred to as the smile because of it appearance from within the kiln, is made of mild steel and has oil passages disposed therein for cooling the structure. It supports refractory that protects the front wall from temperatures between 1500° F. and 220° F. which exist in the kiln due to the introduction of solid charges of waste into the kiln. The front section has been an area requiring continuing repair. The high temperatures cause accelerated corrosion due to oxidation. During the three years the incinerator has been in operation, the smile area has been replaced once and repaired numerous times. The failures were due to cracks in the smile which allowed oil to escape into the kiln. To repair the cracks the kiln had to be shut down and allowed to cool so the cracks could be ground out and seal welded.

SUMMARY OF THE INVENTION

Among the objects of the invention may be noted the provision of reduced potential of smile failures and reduction of spillage of unburned waste material in the air inlet damper.

In general, an improved kiln for burning waste having a rotatable refractory lined kiln drum with a raised front nose ring and a front wall with a smile shaped oil cooled refractory support cantilevered from the front wall to support a cantilevered refractory portion. which extends into the rotatable kiln drum , when made in accordance with this invention, comprises reducing the length of the smile shaped oil cooled refractory support so that its distal end is adjacent the edge of the front end of the front nose ring of the rotatable kiln drum; increasing the height of the nose ring so that it extends radially inwardly beyond the lower portion of the smile shaped oil cooled refractory support; and cantilevering the cantilevered refractory portion that extends into the rotatable kiln drum beyond the smile shaped front wall support structure and over the heightened nose ring, whereby combustion air flows past the smile shaped oil cooled refractory support to provide cooling, increase the life thereof and substantially reduce the amount waste running over the front nose ring.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
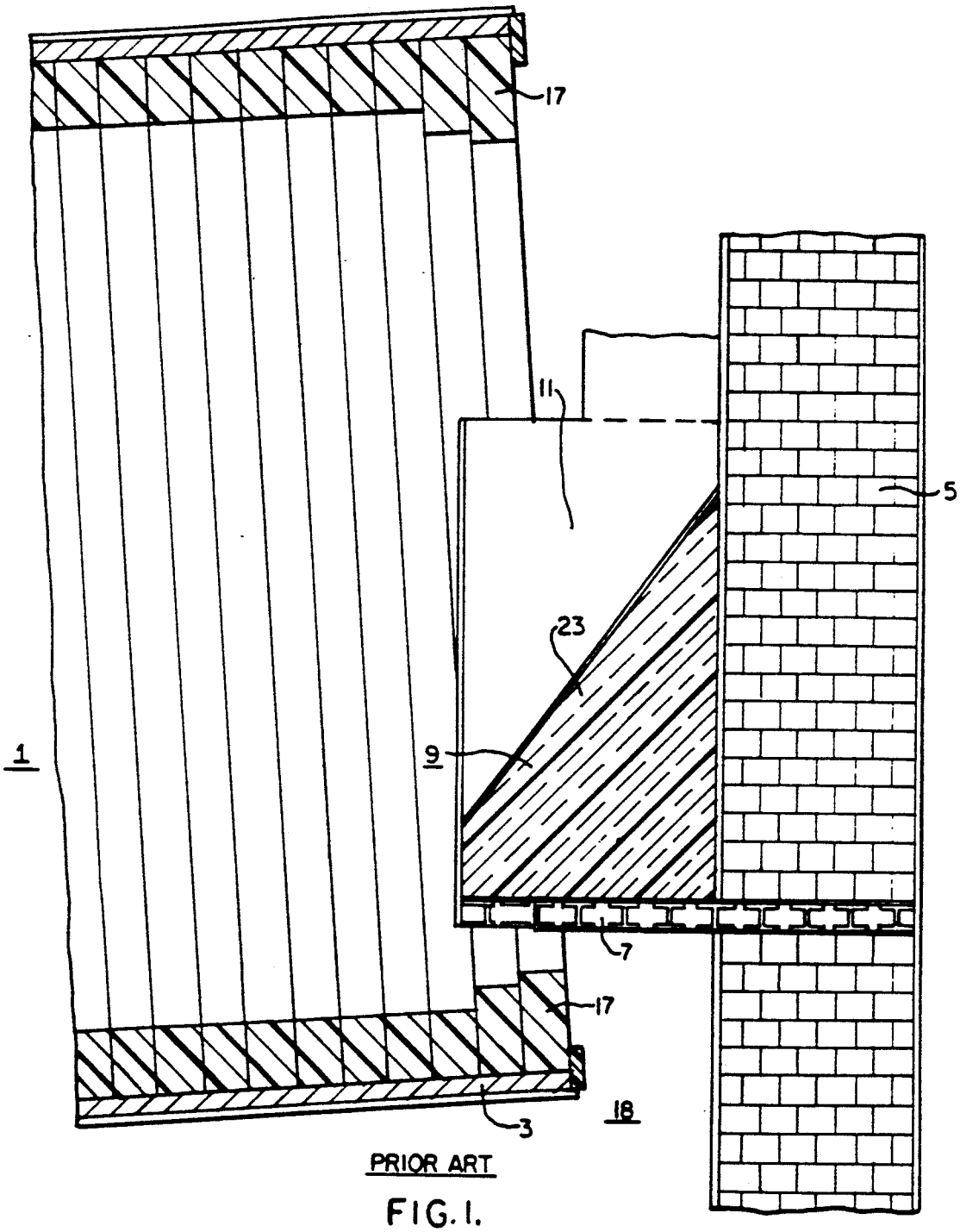
PRIOR ART FIG. 1.
FIG. 1 is a partial sectional view of a prior art slagging kiln.

Referring now to the drawings in detail, and in particular to FIG. 1, there is shown a portion of a slagging rotary kiln 1 having a refractory lined rotatable kiln drum 3 and a front refractory wall 5 having a smile shaped oil cooled steel support 7 cantilevered from the front wall 5 for supporting a refractory heat shield 9 which extends into the refractory lined kiln drum 3 to protect the front wall 5 from the heat energy generated in the kiln drum 3.

Figure 2:
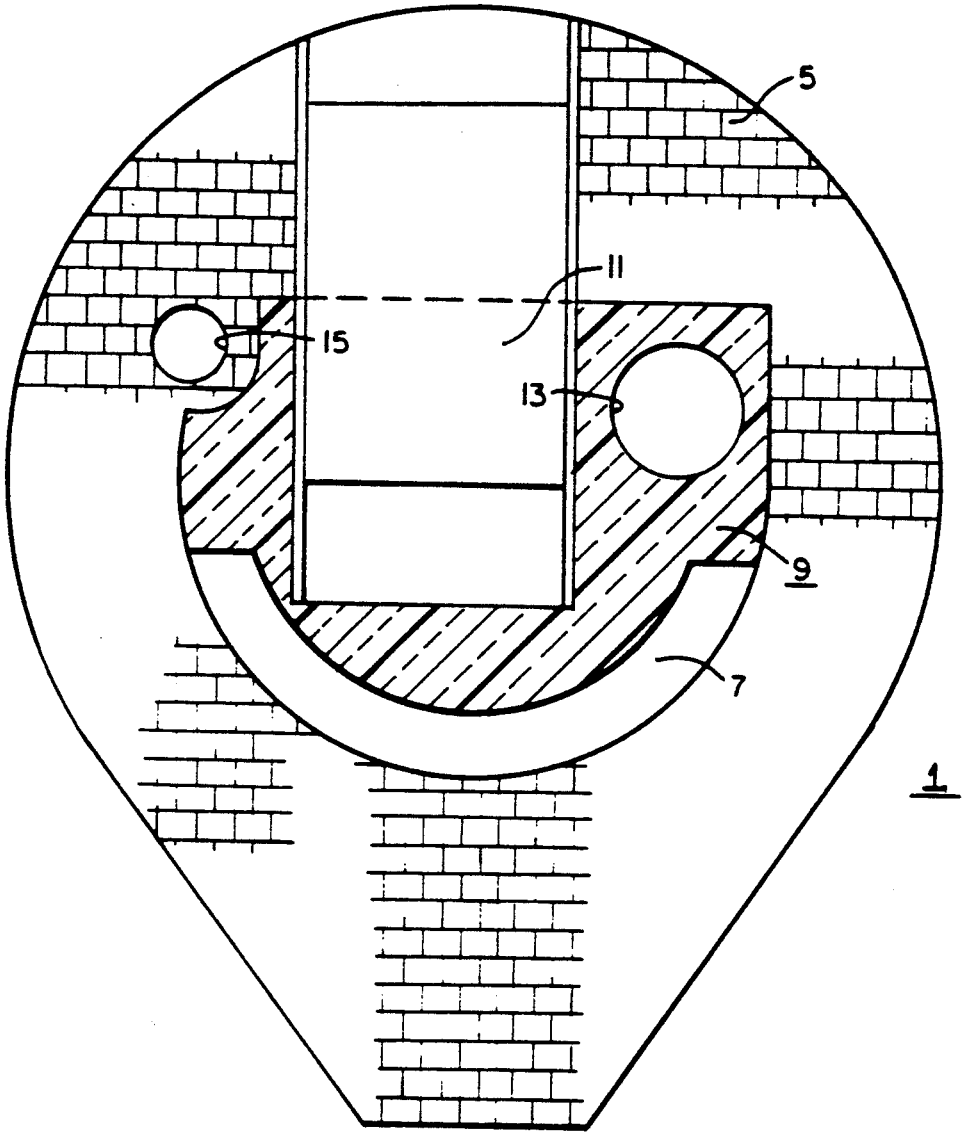
PRIOR ART FIG. 2.
FIG. 2 is a sectional view showing the front wall of a prior art slagging kiln.

As shown in FIG. 2 the refractory heat shield 9 has a waste inlet chute 11, a burner opening 13 and an inspection opening 15 disposed therein. The refractory lined kiln drum 3 has a raised front nose ring 17 forming a dam on the front end thereof. A combustion air duct 18 is disposed adjacent the front wall 5 and a damper (not shown) is disposed under the smile shaped oil cooled refractory support 7 to provide combustion air to the kiln drum 3.

Figure 3:
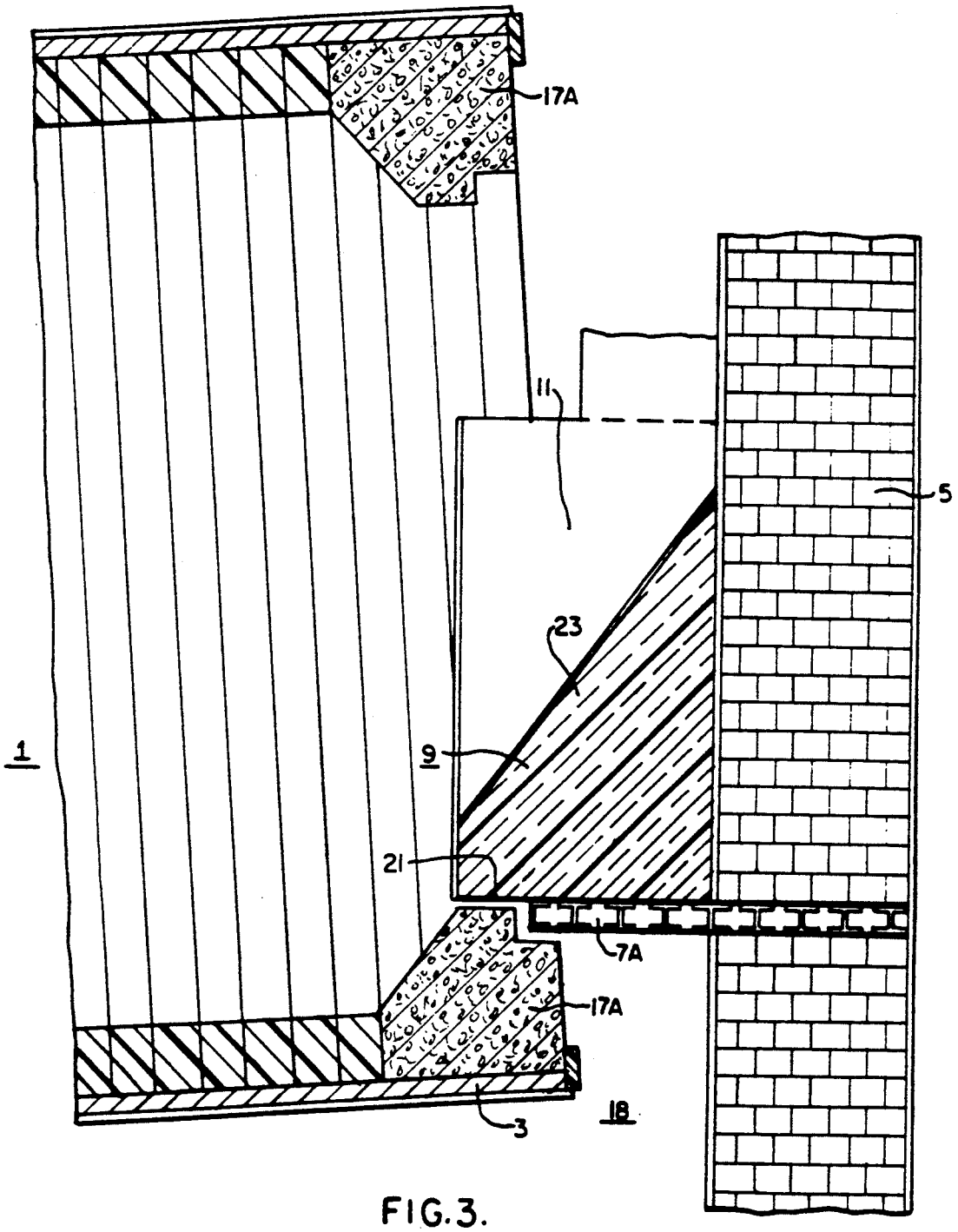
FIG. 3 is a sectional view of an improved slagging kiln.

FIG. 3 shows the improvements made in the kiln 1 and comprise reducing the amount of cantilever or length that a smile shaped oil cooled refractory support 7A extends from the front wall 5 into the kiln 1 so that the distal end thereof is generally adjacent the front edge of a front nose ring 17A. The height of the nose ring 17A is extended radially inwardly so that its inner edge is radially inward of the lower portion of the smile shaped support 7A. In the embodiment shown, the front nose ring 17A is formed of a castable refractory material. The radial inner edge of the nose ring 17A is notched to form a step 19 to provide clearance between the smile shaped support 7A and the nose ring 17A.

The smile shaped support 7A also has a plate portion 21, which is cantilevered out from its distal end to provide support for applying a castable refractory material 23 that will extend into the rotary kiln drum 3 and protect the front wall 5 from the heat generated in the kiln drum 3. Once the castable refractory material 23 has cured, the plate portion 21 is expendable as the cured castable refractory material 23 will support itself over such a short cantilevered span.

The combination of moving the distal end of the oil cooled smile shaped support 7A away from the kiln drum 3, passing combustion air over the distal end of the smile shaped support 7A and raising the height of the nose ring 17A cooperates to shield the distal end of the smile shaped support 7A from the radiant energy generated in the kiln drum 3 and directs relatively cool combustion air over the distal end of the smile shaped support 7A to cool it and inhibit thermal induced stress cracking of the smile shaped support 7A. The combination also helps prevent partially burned material from flowing over the nose ring 17A and into the inlet air duct. When slag rings do occur with this combination of improvements it can be melted out with out causing excessive temperature excursions occurring in the smile shaped support 7A. In the first month after installation of the modifications approximately 1.1 million pounds of solid material has been destroyed in the incinerator and during this period only about 800 pounds of material has come over the front nose ring which is less than would spill over in one hour before the modifications were made. No failure of the smile shaped oil cooled refractory support 7A has occurred since the modifications have been made.

While the preferred embodiments described herein set forth the best mode to practice this invention presently contemplated by the inventors, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. An improved kiln for burning waste, the kiln having a rotatable refractory lined kiln drum with a raised front nose ring and a front wall with a smile shaped oil cooled refractory support cantilevered from the front wall to support a cantilevered refractory portion which extends into the rotatable drum wherein the improvement comprises: the smile shaped oil cooled refractory support having a length so that its distal end is adjacent the edge of the front end of the front nose ring of the rotatable kiln drum; the nose ring having a height so that it extends radially inwardly beyond the lower portion of the smile shaped oil cooled refractory support; and the cantilevered refractory portion extends into the rotatable kiln drum beyond the smile shaped front wall support structure and over the heightened nose ring, whereby combustion air flows over the distal end of the smile shaped oil cooled refractory support to provide cooling, increase the life thereof and substantially reduce the amount of waste running over the front nose ring.

2. The improved kiln of claim 1, wherein the front nose ring has notched front inner edge to provide clearance between the smile shaped oil cooled refractory support and the nose ring.

3. The improved kiln of claim 2, wherein the notch forms a step in the nose ring.

4. The improved kiln of claim 1, wherein the smile shaped oil cooled refractory support has a plate portion cantilevered out from the distal end thereof to provided support for applying a castable refractory material which will extend into the rotatable kiln drum, the plate being expendable once the refractory material is cured.

5. The improved kiln of claim 2, wherein the nose ring is made from a castable refractory material.

6. The improved kiln of claim 1, wherein the nose ring is made from a castable refractory material.

7. The improved kiln of claim 1, wherein the nose ring shields the, distal end of the oil cooled refractory support from a large portion of the radiant energy generated in the rotatable kiln drum.

* * * * *